US006528140B1

(12) United States Patent
Kalin et al.

(10) Patent No.: US 6,528,140 B1
(45) Date of Patent: Mar. 4, 2003

(54) SHOE SOLE WITH DUAL ENERGY MANAGEMENT SYSTEM

(75) Inventors: Frans Xavier Karl Kalin, Diespeck-Dettendorf (DE); Daniel Eugene Norton, Niederndorf (DE); Kwang Ho Park, Manduck 3-Dong (KR); Simon Luthi, Lake Oswego, OR (US); Berthold Krabbe, Scheinfeld (DE)

(73) Assignee: adidas International B.V., Amsterdam (NL)

( * ) Notice: Subject to any disclaimer, the term of this patent is extended or adjusted under 35 U.S.C. 154(b) by 0 days.

(21) Appl. No.: 09/283,923

(22) Filed: Apr. 1, 1999

(30) Foreign Application Priority Data

Apr. 3, 1998 (DE) ..... 198 15 132
Mar. 30, 1999 (DE) ..... 199 14 472

(51) Int. Cl.[7] ..... A43B 13/04

(52) U.S. Cl. ..... 428/139; 428/172; 428/173; 428/492; 428/495; 36/43; 36/44

(58) Field of Search ..... 428/139, 156, 428/161, 172, 173, 492, 493; 525/236, 237, 233, 194, 195; 521/140; 36/43, 44

(56) References Cited

U.S. PATENT DOCUMENTS

| | | | | |
|---|---|---|---|---|
| 3,576,911 A | | 4/1971 | Maxey | 260/876 |
| 4,216,131 A | | 8/1980 | Himes et al. | 260/33.16 |
| 4,316,335 A | | 2/1982 | Giese et al. | 36/129 |
| 4,378,642 A | | 4/1983 | Light et al. | 36/35 R |
| 4,418,483 A | * | 12/1983 | Fujita et al. | 36/28 |
| 4,476,180 A | | 10/1984 | Wnuk | 428/220 |
| 4,610,099 A | * | 9/1986 | Signori | 36/3 B |
| 4,640,797 A | | 2/1987 | Goguen | 252/301.36 |
| 4,779,359 A | | 10/1988 | Famolare, Jr. | 36/29 |
| 4,817,304 A | * | 4/1989 | Parker et al. | 36/114 |
| 4,936,030 A | | 6/1990 | Rennex | 36/28 |
| 5,695,850 A | | 12/1997 | Crow | 428/139 |
| 5,709,954 A | | 1/1998 | Lyden et al. | 428/500 |
| 5,786,057 A | | 7/1998 | Lyden et al. | 428/52 |
| 5,787,610 A | * | 8/1998 | Brooks | 36/28 |
| 6,360,453 B1 | | 3/2002 | Ellis, III | 36/25 R |

FOREIGN PATENT DOCUMENTS

| | | |
|---|---|---|
| DE | 8709757 | 11/1987 |
| EP | 0272082 | 6/1988 |
| EP | 0 904 706 | 3/1999 |

OTHER PUBLICATIONS

Derwent Abstract 1998–378643, Streitz Secura GMBH & Co Kg Louis [Stein].*

* cited by examiner

*Primary Examiner*—Harold Pyon
*Assistant Examiner*—Sow-Fun Hon
(74) *Attorney, Agent, or Firm*—Testa, Hurwitz & Thibeault, LLP.

(57) ABSTRACT

An article of footwear provides a dual energy management system to improve the biomechanical properties of the article of footwear. The article of footwear includes a forefoot portion, a rearfoot portion, and a sole layer. The sole layer is divided into a first area and a second area. The first area extends over the forefoot portion and comprises an elastic material. The second area extends over the rearfoot portion and comprises a viscous material.

21 Claims, 7 Drawing Sheets

SHOE SOLE WITH DUAL ENERGY MANAGEMENT SYSTEM

CROSS-REFERENCE TO RELATED APPLICATIONS

This application incorporates by reference, and claims priority to, and the benefit of, German patent application serial number 19815132.2, which was filed on Apr. 3, 1998, and German patent application serial number 19914472.9, which was filed on Mar. 30, 1999.

TECHNICAL FIELD

The invention relates to an article of footwear that provides a dual energy management system to improve the biomechanical properties of the article of footwear.

BACKGROUND INFORMATION

During each footfall in walking, running and jumping, forces are acting between the ground and the foot. These forces are usually referred to as ground reaction forces (GRF). They can be quantified using appropriate measuring devices. The order of magnitude of the GRF for walking is typically 1 to 1.5 times an athlete's body weight (BW). In running, the forces are typically between 2 to 3 times BW, and in jumping the forces are typically between 5 and 10 times BW. To compensate for the forces occurring during walking, running and jumping, complex movements take place in the human body, which lead to considerable stress on the anatomy.

If an average runner runs a distance of approximately 1 kilometer, his feet contact the ground approximately 1,000 times. This leads to a considerable accumulation of arising impacts, i.e., resulting shocks. For example, a person with a body weight of approximately 68 kilograms who runs a distance of approximately 32 kilometers per week is exposed to a force equivalent to approximately 4 to 6 million kilograms per week. For an athlete to sustain such a stress without any damage it is necessary for the body to compensate for, or absorb, the shock in a harmless way.

To this end, the human body is provided with a number of natural mechanisms. A portion of the shock is already absorbed by the moving parts of the body consisting essentially of bones, muscles, and cartilage. Furthermore, the human foot comprises cushioning consisting of fat and cartilage for damping the impact and reducing the stress. In addition, the degree of bending of the knee can play an important role in the influence of the impact forces during running. For example, it has been shown that the vertical force impact peak (VFIP), i.e., the force that is measured when the heel contacts the ground, is reduced by an increase in the degree of bending of the knee during running. Experiments confirm that the VFIP values occurring in persons who contact the ground first with the midfoot or forefoot area are negligible. The VFIP A values depend heavily on boundary conditions, such as, the speed of running and the hardness of the ground.

For a long time, consideration has been given to protecting the human body against impacts by providing footwear with cushioning. If footwear cushioning is to be optimized for specific kinds of sports, it is helpful to obtain information about GRF, i.e., the forces occurring when the foot contacts the ground. GRF designates all forces which act upon the foot or the body during contact with the ground. Furthermore, it is helpful to consider the time dependence of the forces acting on the foot or body.

The force-time pattern for each foot-ground interaction typically shows two distinct phases; an impact phase when the foot collides with the ground followed by a push-off phase when the athlete is propelled forward and upwards. FIG. 1*a* shows the landing motion of the foot in long distance running. About 80% of all runners contact the ground with the heel first. FIG. 1*b* shows the following push-off of the midfoot and forefoot. The corresponding vertical component of the GRF is shown in FIG. 1*c*. As can be seen, the curve consists of two distinct force maxima. The first maximum, corresponding to point P in FIG. 1*c*, occurs after 20 to 40 milliseconds (ms) as a result of heel impact. This value P was designated above as the vertical force impact peak (VFIP). Sometimes this peak value P is also called the "passive peak value" because during this short time interval the human body can not react and adjust to it. The second maximum, corresponding to point A in FIG. 1*c*, occurs after 80–100 ms and is caused by the push-off action of the midfoot or forefoot from the ground during running to move the runner forward and upwards for the next step. This peak value A is called the "active peak value" or the "propulsion peak value."

Studies have shown that the relative height of the passive and active peak values can vary with respect to each other depending on; the kind of sport, speed of running, anatomical formation of the feet, etc. In some cases, the values shown in FIG. 1*c* can change such that the active peak value has the same height as the passive peak value or even higher. It is, however, typical that two peak values occur which are separated by approximately 60 milliseconds.

The two types of forces have different consequences with respect to the human musculoskeletal system. Impact forces do not contribute to athletic performance. Impact forces, however, have been associated in a number of studies with chronic and degenerative injuries in various sports, especially, when the heel is involved. The goal, therefore, is to reduce impact forces under the heel using appropriate footwear sole constructions. The desired systems are the ones that deform easily under load and dissipate energy.

Magnitude and duration of active forces determine athletic performance, i.e., running speed and jumping height. This means, if an athlete wants to run at a certain speed, the appropriate level of active forces must be maintained. Thus, the intention is to enhance these forces with a footwear sole that minimizes energy dissipation as much as possible, and at the same time provides the necessary cushioning.

With respect to cushioning systems in footwear, and to deal with the undesired results of the forces, as discussed above, and to use these forces advantageously, the following approaches were used in the prior art. In U.S. Pat. No. 5,695,850, the concept is known to provide a sports shoe with a sole unit that is said to improve the performance of the shoe. This is to be achieved by using components of the shoe or the sole which "regain" the energy during running and transform it during the push-off phase from the ground, i.e., in the area of the active peak value in FIG. 1*c*, into a forward movement. To this end, the use of elastic materials either in the complete sole area or limited to the forefoot area is disclosed. Suitable elastic materials are, among others, 1,4-polybutadiene/rubber compounds or, as an inlay for the shoe, a mixture of ethylene vinyl acetate (EVA) and natural rubber.

German patent no. DE 87 09 757 discloses a sole unit consisting of an outsole and a midsole mounted thereon. The midsole is formed by a comparatively narrow frame-like extending strip defining a seat that is downwards closed by the outsole. Inside the seat two sole parts are provided, one of which extends from the forefoot part of the shoe to the beginning of the heel part where the second sole part is provided. The first sole part consists preferably of a plastic supporting inlay being comparatively yielding under pressure so that during walking with such a shoe a foot bed can be formed on the sole part providing a certain level of comfort. The sole part arranged in the heel area provides a shock absorber and consists of impact or shock absorbing material, for example, silicon.

U.S. Pat. No. 4,108,886 also describes the use of shock absorbing inlays in the heel part of a sole unit. U.S. Pat. No. 4,316,335 discloses the use of a shock absorbing material not only in the forefoot part of a sole, but also in the heel part, wherein, the damping properties of the heel part are better than in the forefoot part.

European patent no. 0 272 082, discloses the use of a spring plate in the forefoot area of a sole unit. The spring plate is used to take up energy during each step and to release the energy during the push-off phase.

All of the above described known concepts have the disadvantage that the suggested materials and material parameters for the heel or forefoot area are not adjusted or optimized for the time dependence of the above described passive and active peak values. Furthermore, the suggested materials are not coordinated with the other materials used in the sole so possible additional effects are not taken into account. Therefore, the intended effect is only partly achieved and during running a "spongy" or "springy" feeling arises, which considerably hinders forward movement.

SUMMARY OF THE INVENTION

It is an object of the invention to provide a well-balanced sole unit where the passive and active force peak values arising during the natural course of motion are optimally taken into account, and the natural dynamics of the movement are optimally used. It is another object of the invention to provide a sole unit having a low cost and long durability.

In general, the solution of the above problem is obtained by a sole unit for an article of footwear, comprising at least one sole layer. According to the invention, this sole unit is divided from front to rear, i.e., the horizontal direction, into at least two different parts. The first horizontal part extends over the forefoot portion of the article of footwear. The forefoot portion can include either the forefoot area of the sole or the forefoot and midfoot areas of the sole. The second horizontal part extends over the rearfoot portion.

The present invention includes a unique feature, which provides in the forefoot portion of the sole unit a layer of material having a predominantly elastic damping characteristic. Such a material has, in a forward movement, the characteristic that the pushing-off from the ground is supported by the "elastical back scattering" of the kinetic energy, i.e., the conversion of the elastic potential energy stored in the elastic material to kinetic energy. In contrast, the rearfoot portion of the sole unit (the heel part), preferably includes a material layer having a predominantly viscous damping characteristic. The use of a viscous material leads to repulse-free absorption of the impacts occurring during running, in particular on the heel of the foot, since the energy of the impact is transformed into heat.

The elastic and viscous materials used according to the invention are characterized by their material specific energy loss. The inventors have discovered that the critical material parameter of optimal materials for the rearfoot area and the forefoot area is the loss of energy. The energy loss is the parameter obtained from the response of a test material exposed to a force, and is to be determined experimentally.

To determine the response in a biomechanically adjusted manner, a procedure is used where a sample of the material to be tested is subjected to a dynamic force corresponding to the force acting upon the feet during human running. Preferably, a GRF-force profile like that shown in FIG. 1*c* (separately for the forefoot and rearfoot area) acts upon the test material. A certain energy is fed into the material leading to a deformation of the body of the material. This deformation is the result of the material's specific elastic properties having a certain time dependence and thereby leads to a recuperation of the energy, i.e., the energy fed into the material is returned by the springing back of the material. The energy recuperated in this way is for physical reasons always less than the fed energy, since a part of it is, depending on the material, transformed into heat. If the recuperated energy is subtracted from the fed energy, a positive difference is obtained which can be designated as "loss of energy."

According to the invention, it has been shown that elastic materials suitable for the forefoot portion should have an energy loss not exceeding about 30%, preferably not exceeding about 27%, and more preferably not exceeding about 24.5%, which leads during the push-off phase of the foot to a measurable support for the upward and forward movement of the foot. Furthermore, it has been shown that it is beneficial for the viscous material used according to the invention for shock absorbing in the rearfoot portion, to have an energy loss exceeding about 50%, preferably exceeding about 55%, and more preferably exceeding about 60% to lead to a measurable reduction of the risk of injury. Finally, it has been shown according to the invention that by a combination of elastic and viscous materials in the forefoot and rearfoot portions, respectively, which have a difference in loss of energy exceeding about 20%, preferably exceeding about 28%, and more preferably exceeding about 35.5%, a combined effect is obtained leading to the improved performance of the athlete, i.e., the running or walking takes place with reduced energy consumption. This was experimentally determined by comparative studies of the oxygen consumption of athletes.

In one aspect, the invention relates to an article of footwear including a forefoot portion, a rearfoot portion, and a sole. The sole includes a first area which extends at least partially over the forefoot portion and a second area which extends at least partially over the rearfoot portion. The first area is constructed of a predominantly elastic material having a material specific loss of energy that does not exceed about 30%, preferably not exceeding about 27%, and more preferably not exceeding about 24.5%.

In another aspect, the invention relates to an article of footwear including a forefoot portion, a rearfoot portion, and a sole. The sole includes a first area which extends at least partially over the forefoot portion and a second area which extends at least partially over the rearfoot portion. The second area is constructed of a predominantly viscous material having a material specific loss of energy that exceeds about 50%, preferably exceeds about 55%, and more preferably exceeds about 60%

In yet another aspect, the invention relates to an article of footwear including a forefoot portion, a rearfoot portion, and a sole. The sole includes a first area which extends at least partially over the forefoot portion and a second area which extends at least partially over the rearfoot potion. The first area is constructed of a predominantly elastic material having a material specific loss of energy. The second area is constructed of a predominantly viscous material having a material specific loss of energy. In this aspect, the difference between the loss of energy in the first area and the loss of energy in the second area exceeds about 20%, preferably exceeds about 28%, and more preferably exceeds about 35.5%.

Embodiments according to the foregoing aspects of the invention can include the following features. The first and second areas of the sole unit can be disposed in the same layer of the sole unit or in two different layers of the sole unit. The sole unit can include at least one additional material layer, for example, an insole or an outsole. If additional layers are used, it is necessary to take additional material parameters into consideration, for example, the dynamic stiffness of both the elastic and viscous material in comparison to the dynamic stiffness of the material(s) that form the additional layers. The dynamic stiffness is the slope of the curve in a force-deformation diagram, like that shown in FIGS. 3 and 4, between certain force intervals; for example, between 1000N–1,5000N and between 200N–400N.

Taking the dynamic stiffness into account in embodiments where the sole unit consists of several layers is important, since the elastic properties in the first area and the viscous properties in the second area do not take effect if the wrong materials are chosen. The situation is as in a series of two coupled springs. The effect of spring 1 with a specially adapted spring characteristic does not take effect, if the spring constant of the second spring is smaller than the spring constant of the first one. In this case the damping characteristic of the coupled springs is predominantly determined by spring 2. Only after spring 2 has been completely compressed, does spring 1 becomes effective.

In an embodiment of the invention including a sole unit with additional layer(s), the additional layer(s) preferably comprises material(s) with a dynamic stiffness equal to or greater than the dynamic stiffness of the viscous and elastic materials. For the viscous material, this is particularly relevant for forces between 200N and 400N.

Suitable elastic synthetic materials for constructing the sole first area in accordance with the invention can comprise a combination of ethylene vinyl acetate (EVA) and natural rubber. For example, the elastic synthetic materials can comprise 50% ethylene vinyl acetate (EVA) and 50% natural rubber. Suitable viscous materials for constructing the sole second area in accordance with the invention can comprise a butyl-polymer. These synthetic materials are particularly suited as materials for a sole unit for the dual energy management system according to the invention.

These and other objects, along with advantages and features of the present invention herein disclosed, will become apparent through reference to the following description of embodiments of the invention, the accompanying drawings, and the claims.

BRIEF DESCRIPTION OF THE DRAWINGS

In the drawings, like reference characters generally refer to the same parts throughout the different figures. Also, the drawings are not to scale; emphasis instead generally being placed upon illustrating the principles of the invention. Further preferred embodiments of the present invention are discussed in the following with reference to the drawings which show.

DESCRIPTION

To illustrate the principles of the invention, a foot and its natural course of motion during running is discussed with reference to FIGS. 1*a* and 1*b*. FIG. 1 shows a human foot with a shoe 10 comprising a shaft 20 and a sole unit 50. As discussed in further detail below, the sole 50 can consist of a plurality of layers called a layer ensemble. As shown in FIG. 1*b*, about 80% of humans begin the course of motion of a step with the contact of the heel part of the foot with the ground. At this time, the human body is subjected to a heavy impact. In the subsequent phase of rolling-off, the affecting force decreases at first until the moment of the pushing-off (FIG. 1*b*) where it increases again, thus resulting in a force-time diagram, such as is shown in FIG. 1*c*, having a curve with two maxima.

Figure 1A:
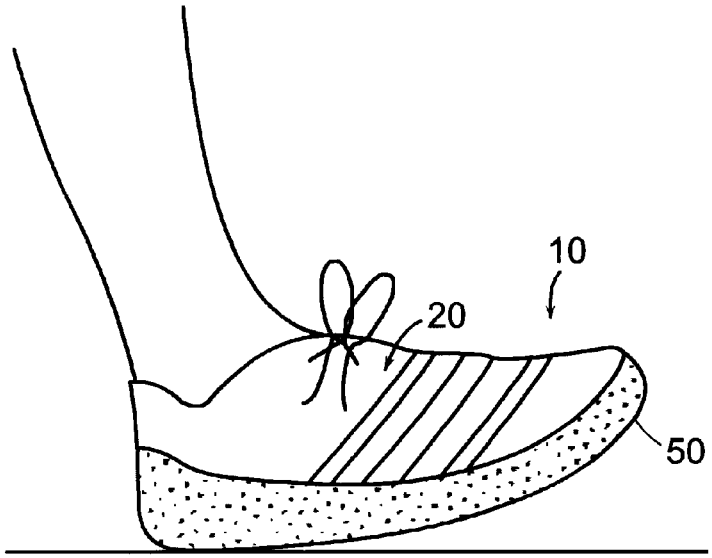
FIG. 1 the natural course of movement of a foot during running (FIGS. 1*a* and 1*b*), and the resulting GRF-force profile (FIG. 1*c*)
Figure 1B:
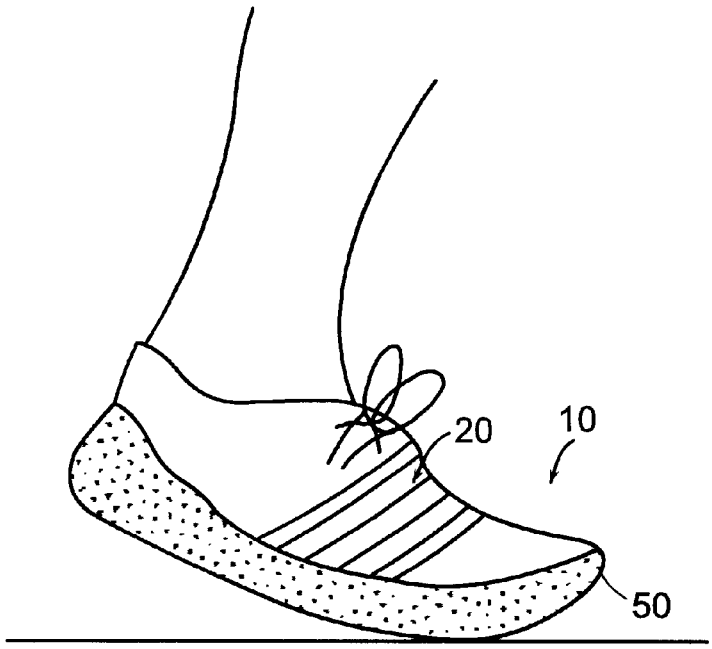
Figure 1C:
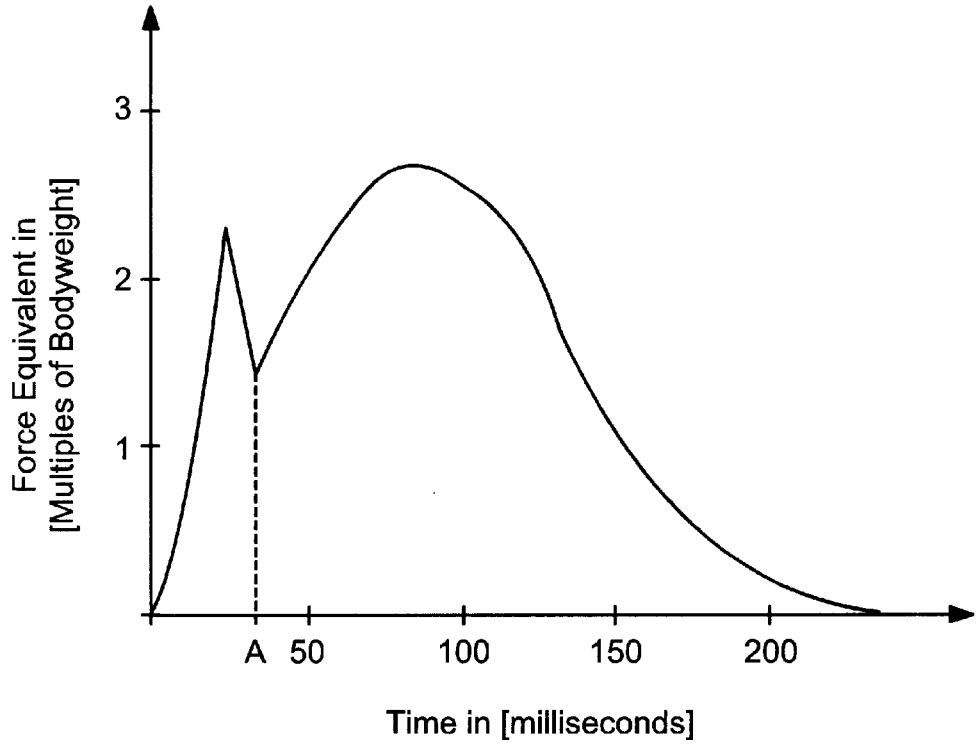

If for the confirmation of the above, a test subject performs the typical course of motion during running on a force-time measurement platform, the force profile shown in FIG. 1*c* is obtained. Laid off as ordinate is the force equivalent (in multiples of the weight) and as abscissa the time in milliseconds. The diagram shown in FIG. 1*c* is also called a GRF-diagram since the forces exerted during a step on the foot are also called "ground reaction forces" (GRF).

Figure 2A:
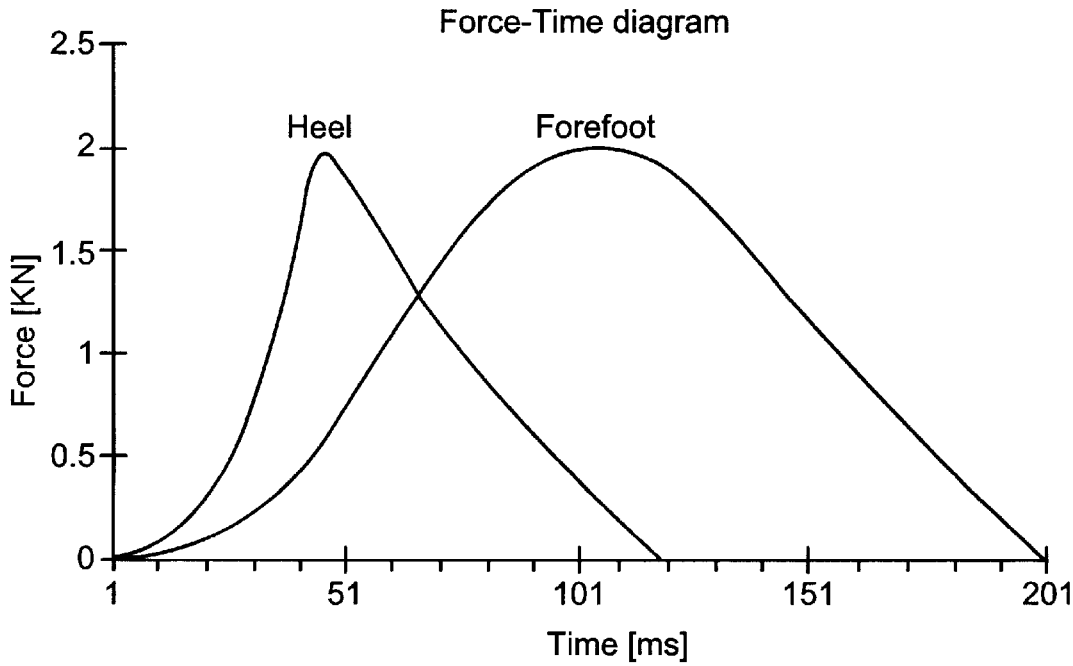
FIG. 2*a* a force-time-diagram of two forces, which are exerted according to the invention by a measuring apparatus onto the rearfoot portion and the forefoot portion of sole units or material layers to determine the loss of energy and the dynamic stiffness of the sole units or material layers.

As can be derived from FIG. 1*c* showing a typical example of a GRF-curve, the curve shows after about 20–40 ms a first sharp maximum resulting from a rapidly increasing force that corresponds in the example shown in FIG. 1*c* to 2.5 times the weight. As already mentioned in the Background Information section, this first peak value is also called the "vertical force impact peak value" (VFIP-value). The phase shown in FIG. 1*c* as ranging from t=0 to t=A (approximately 30 ms to 50 ms) in the GRF-diagram is called the passive phase. It corresponds to the contact of the heel part of the foot with the ground (FIG. 1*a*).

The active phase follows the passive phase of the course of motion in the exemplary GRF-diagram shown in FIG. 1*c*. The increased force in the active phase is caused by the pushing-off of the foot from the ground (FIG. 1*b*). The resulting impact on the human body is considerably smaller, since the increase of the force acts slower than in the passive phase (approximately 80 to 100 milliseconds). The profile of the GRF diagram can vary significantly depending on the boundary conditions, such as, running speed, anatomy of the foot, hardness of the ground, etc.

Because the increase of the force in the passive phase is considerably faster than in the active phase, the affecting impulse (impact of the force) is correspondingly higher, which leads to a higher stress on the heel. Furthermore, the impulse occurring during the contact with a hard surface is reflected from the ground so that it has to be absorbed by the anatomy. This leads to considerable signs of injury or degeneration, in particular, during long lasting stress such as a marathon race. In contrast, the stress on the forefoot part is, for the reason of a smaller impact (a longer force increasing time), correspondingly smaller. Furthermore, the forefoot area comprises a larger area and an anatomy which allows better body-internal damping. For these reasons, it was deduced that the heel part needs in comparison to the forefoot part better protection to avoid an anatomical injury. In addition, because the forces increase less rapidly in the forefoot area, the forefoot is better able to adjust to the increase of force, which is smaller in this case.

The forefoot area of a sole having a characteristic that results in the reflection of the impact force in the running direction or away from the ground is advantageous. Referring to FIG. 1*b,* if during the contact of the forefoot with the ground, kinetic energy is transferred to the foot again, this facilitates the pushing-off of the foot from the ground and thereby support of the forward movement.

The present invention is, therefore, based on the need to provide in the heel part and in the forefoot part of a sole unit materials with different properties. In the forefoot part an elastic material is preferably used, whereas in the heel part a viscous material is preferably used. There are, however, no purely elastic or purely viscous materials in nature; there is always a combination of these two properties. Therefore, in the present invention, elastic and viscous materials are materials with elastic-viscous properties where one or the other property is more or less strongly developed. A material according to the invention is considered "elastic" if it is predominantly elastic, i.e., if it has only to a small extent viscous properties. On the other hand, a material according to the invention is considered "viscous" if it has predominantly viscous properties, i.e., only to a small extent elastic properties.

In this context, elastic means that the material elastically springs back under the influence of a force or force impacts and ideally completely releases the energy taken up during the impact, i.e., the material produces an elastical back scattering of kinetic energy. Materials with viscous properties are materials that transform a large part of the received energy into heat, i.e., the material elastically deforms insignificantly.

If a viscous material within the meaning of the invention, as described above, is used in the heel part of a sole unit, it has the ability to at least partly transform the impact transferred by the heel into heat and to avoid the impact quasi-reflected from the ground and the heel stress. As a result, a very "soft" running feeling is subjectively felt by the runner. In contrast, the predominantly elastic material preferably used in the forefoot area has the ability to push-off the foot from the ground and to quasi-catapult the runner forward, since it quasi-reflects the impact from the ground.

It follows from the above that the loss of energy occurring during deformation is particularly suited to characterize or quantify viscous and elastic materials. This parameter (measured in percentage) describes the relation of the energy fed by the force applied to the material to the energy regained by the springing back.

Figure 2B:
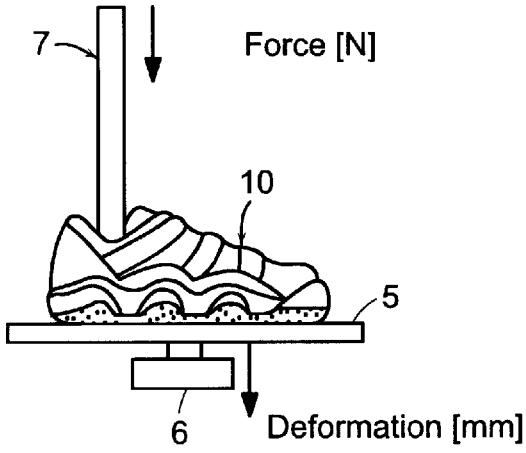
FIG. 2*b* a measuring apparatus according to the invention as it is used for exerting the force profiles shown in FIG. 2*a* and the measurement of the resulting deformations, and thereby the loss of energy and the dynamic stiffness.
Figure 2C:
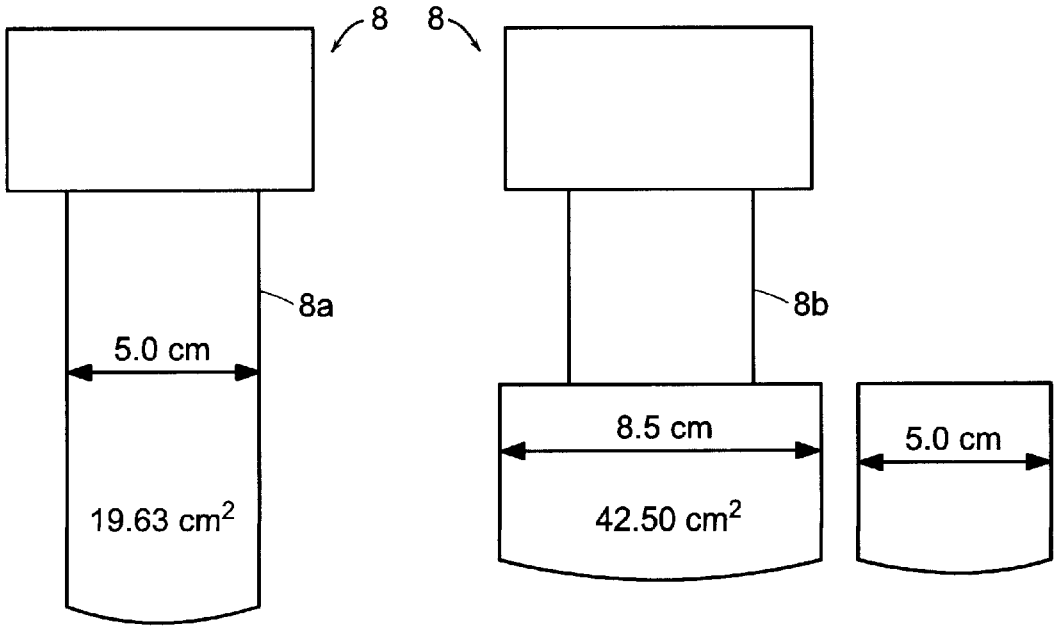
FIG. 2*c* the force stamps used in the apparatus according to FIG. 2*b* for the rearfoot portion and the forefoot portion.

To determine the material specific loss of energy of a suitable material, an apparatus as shown in FIG. 2*b* can be used. This apparatus consists of a platform 5 on which the material to be studied is arranged. This material can be present either as a single material layer or as a finished article of footwear as shown. In either case, it is desirable, though not required, that for testing in accordance with the present invention the material sample is provided in the same thickness and preferably the same shape as it is to be used in the particular article of footwear. The material to be studied is then by the aid of a stamp arrangement 7 subjected to a defined force. Below the platform 5, a measuring arrangement 6 (schematically drawn) is located to measure the resulting deformation of the test material (in millimeters). The setup of the stamping arrangement 7 and the measuring arrangement 6 is known to the person skilled in the art and does not have to be further described. A corresponding device is commercially available on the market and under the trade name Instron Testing Machine, Testing Frame 8502 from Instron Limited, High Wycombe, Great Britain.

To simulate the actual conditions as realistically as possible, the force applied by the aid of the stamp 8 (FIG. 2*c*) of the stamping arrangement 7 has different profiles. Therefore, for the study of suitable viscous materials, a force profile can be used which is designated in FIG. 2*a* with the term "heel." A stamp 8*a* is used having a geometry that is similar to the human heel. The stamp 8*a* has a circular cross section with a diameter of 5 cm (FIG. 2*c*), and a cross sectional area at its bottom side (which is slightly curved) of 19.63 $cm^2$. For the measurement of suitable elastic materials, a force profile can be used which is designated in FIG. 2*a* with the term "forefoot." The stamp 8*b* used for this measurement (FIG. 2*c*) has a geometry that is similar to the human forefoot. Stamp 8*b* is an elongated shape having a length of 8.5 cm and a width of 5.0 cm. The cross-sectional area at the bottom side, which is again slightly curved, is 42.50 $cm^2$. Finally, it is desirable, though not required, to use test materials with thicknesses that are common in footwear, for example, 10 millimeters in the forefoot part and 20 millimeters in the rear foot part.

Figure 3:
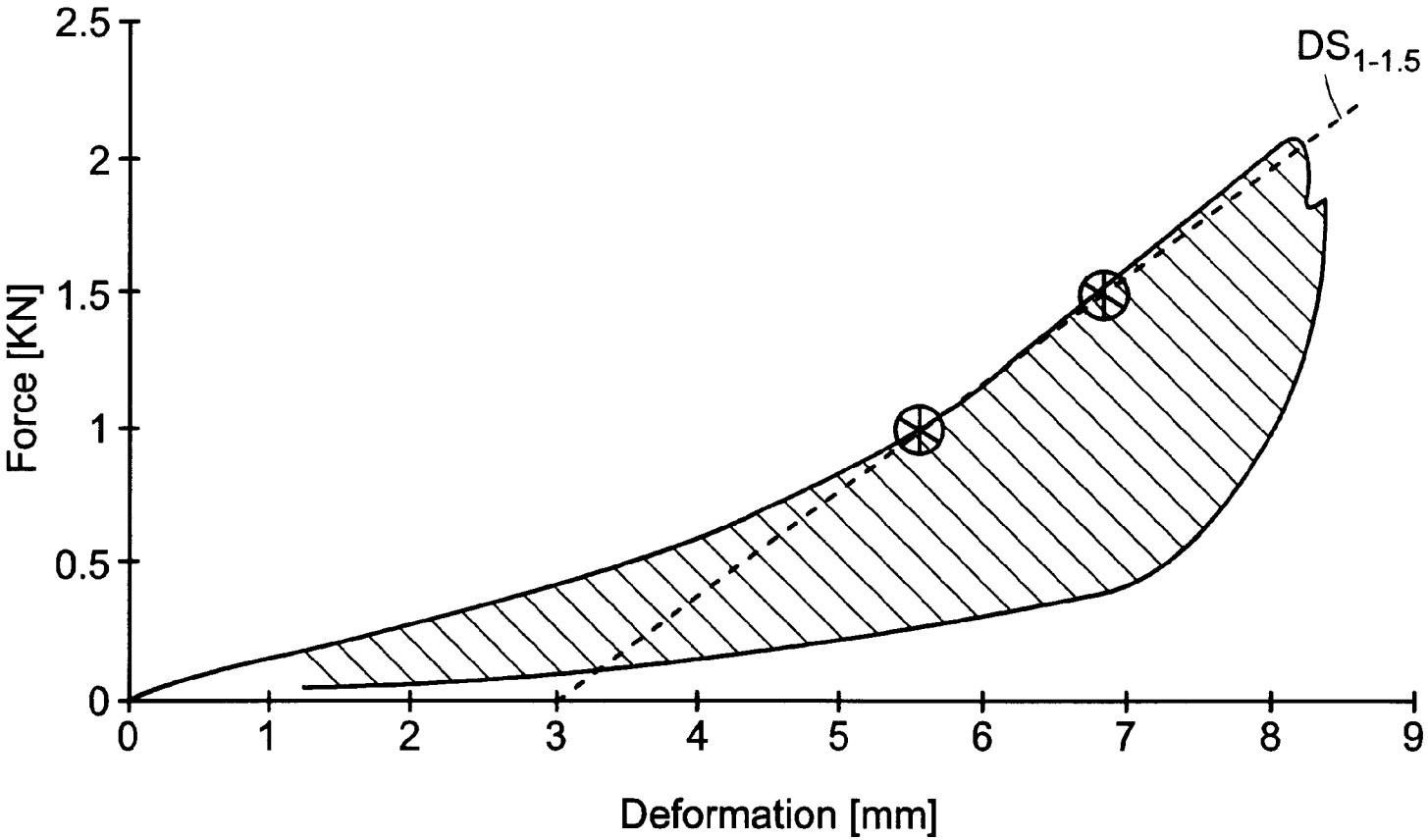
FIG. 3 the deformation characteristic of a viscous material with the resulting loss of energy (hatched) and the dynamic stiffness (DS) between 1 KN and 1.5 KN.

In the following, the experimental results obtained by the measurement apparatus 6 and 7 (FIG. 2*b*) are discussed with reference to FIGS. 3 and 4. FIG. 3 shows the deformation characteristic of a viscous material according to the invention, which is subjected to the force profile designated "heel" in FIG. 2*a* by the apparatus shown in FIG. 2*b*. The deformation measured with the apparatus 6 is laid off as abscissa and the force applied with the stamp 7 as ordinate. As can be derived from FIG. 3, the viscous material used in the heel part shows a pronounced hysteresis behavior. During the increase of the force according to the force profile "heel" from FIG. 2*a,* a deformation appears which only slowly recedes with a substantially smaller counterforce on the stamp 8*a*. The resulting loss of energy can be graphically or numerically established and is represented by the hatched area in the diagram. As can be seen, a large part of the fed energy is transformed into heat in the viscous material and is no longer available as a restoring force when the material goes back into its original shape.

Apart from the loss of energy, a further parameter that relates to the present invention, the dynamic stiffness of the material, can be deduced from the graph in FIG. 3. The dynamic stiffness is defined as the relationship between the exerted force F [N] and the resulting deflection d [mm]. Experiments have shown that for footwear, in particular sport shoes, two ranges of the dynamic stiffness are of particular interest. The stiffness between 1000 N and 1500 N and the stiffness between 200 N and 400 N. These ranges are of interest for sport shoes, depending on their field of use. The dynamic stiffness between 1000N and 1500N is calculated as follows:

$$\text{Dynamic stiffness } DS_{1000\text{-}1500}=(F_{1500N}-F_{1000N})/(d_{1500N}-d_{1000N})[N/mm]$$

Where $F_{1500N}$ is an applied force of 1.5 KN, $F_{1000N}$ is an applied force of 1 KN, $d_{1500N}$ is the deformation resulting from the 1.5 KN force, and $d_{1000N}$ is the deformation resulting from the 1 KN force. The value for the dynamic stiffness between 200 N and 400 N is correspondingly calculated, however, it is not shown graphically in FIG. 3.

The dynamic stiffness of interest is of the sole units that consist of layer ensembles, i.e., a plurality of layers of different materials; for example, an inner layer, an intermediate layer, the layer(s) with the functional properties according to the invention, i.e., the functional layer(s), and an outsole. In such an arrangement, the above described effect is only obtained if the stiffness of the functional layer(s) is not greater than the stiffness of the materials of which the other layers consist. As materials for the sole layers, ethylene vinyl acetate (EVA) and polyurethane (PU) in particular are used since they can be easily processed and have a low cost. If the elastic-viscous properties of these materials are not to determine the overall properties of the sole, it is necessary that the dynamic stiffness of the viscous and elastic materials according to the invention be less than the dynamic stiffness of these materials.

Figure 4:
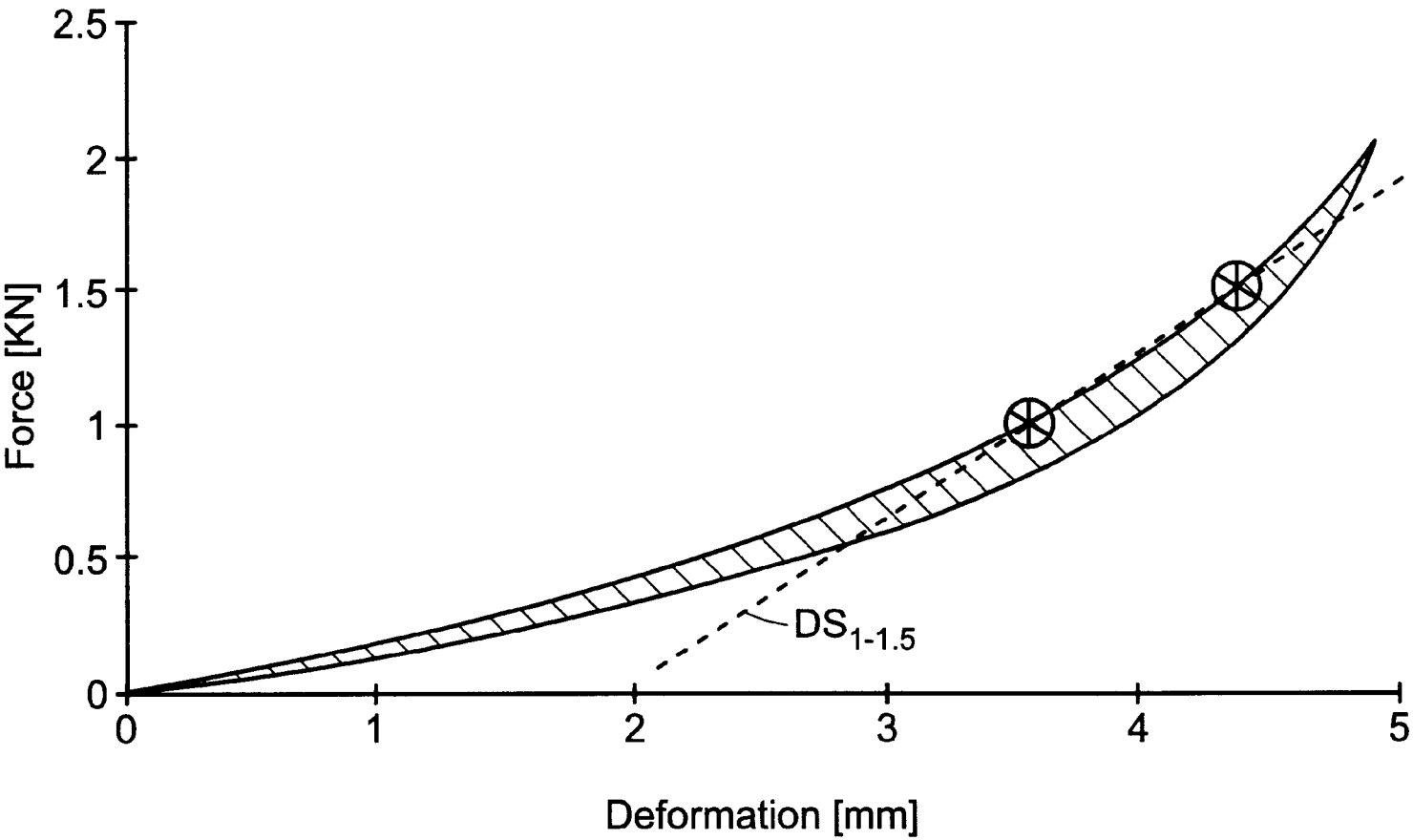
FIG. 4 the deformation characteristics of an elastic material with the resulting loss of energy (hatched) and the dynamic stiffness (DS) between 1 KN and 1.5 KN.

FIG. 4 shows the response of an elastic material according to the invention. As can be derived from FIG. 4, the elastic material shows only a very weak hysteresis behavior and, therefore, only a very small energy loss in the meaning of the invention. The material goes quasi immediately back into its original shape when the force decreases so that essentially the complete energy fed via the force stamp 8*b* is released. Here also, the value of the dynamic stiffness between 1000N and 1500N is graphically presented (the corresponding value for the dynamic stiffness between 200N and 400N was left out once again for the sake of simplicity).

In a detailed study carried out in conjunction with the present invention, it was found that to obtain the effect according to the invention, it is desirable to achieve certain values, not only for the loss of energy in the elastic and viscous material, but preferably also (in the case of footwear with several layers of different materials) for the dynamic stiffness (DS). Exemplary values which when achieved exploit advantages of the invention, are summarized in the table below:

| Parameter | Elastic Material | Viscous Material |
|---|---|---|
| Energy Loss (%) | <27% | >55% |
| Dynamic Stiffness (Force Range: 200 N–400 N) | <300 N/mm | <130 N/mm |
| Dynamic Stiffness (Force Range: 1000 N–1500 N) | <600 N/mm or <450 N/mm | <250 N/mm or <200 N/mm |

It is considered, therefore, that the energy loss of the elastic material according to the invention should not exceed about 30%, and in particular embodiments it should not exceed about 27%, and in other embodiments it should not exceed about 24.5%. In contrast, the energy loss in the viscous material according to the invention should be at least about 50%. and in particular embodiments it should be at least about 55%, and other embodiments it should be at least about 60%. Comparative studies have confirmed that with a resulting minimal loss difference of at least about 20%, preferably at least about 28%, and more preferably at least about 35.5% between the forefoot and the rearfoot, a considerable reduction in the risk of injuries within the range of the vertical force impact peak value is obtained, and within the range of the active peak value the stored energy is optimally released again. The result is footwear which is not only very comfortable to wear without the danger of injuries, but which also improves the performance of the athlete. Comparative studies with normal footwear have shown that athletes running a certain test distance with footwear in accordance with the present invention consumed less oxygen.

Concerning the values for the dynamic stiffness, the situation is more complex. Depending on the kind of sport, the situation is different since different kinds of sports lead to different requirements for footwear. For example, it was found that in field sports (basketball, volleyball, soccer) the dynamic stiffness of the elastic material should be less than about 600 N/mm for a force between 1000 N and 1500 N, and the dynamic stiffness of the viscous material should be less than about 250 N/mm for the same force.

In the case of running shoes, however, the dynamic stiffness of the elastic material should be less than about 450 N/mm for a force between 1000 N and 1500 N, and the dynamic stiffness of the viscous material should be less than about 200 N/mm for the same force.

For a universal article of footwear the following is a good compromise. The dynamic stiffness of the elastic material should be less than about 600 N/mm for a force between 1000 N and 1500 N, and less than about 300 N/mm for a force between 200 N and 400 N; the dynamic stiffness of the viscous material should be less than about 250 N/mm for a force between 1000 N and 1500 N and less than about 130 N/mm for a force between 200 N and 400 N.

In view of the above discussed parameters, it has been found that the following materials are suitable for the present invention:

TABLE 1

Elastic Material I.

| Parameter | Material (VGB-1A) |
|---|---|
| Loss of Energy (%) | 24.5% |
| Dynamic Stiffness (Force Range: 200 N–400 N) | 230 N/mm |
| Dynamic Stiffness (Force Range: 1000 N–1500 N) | 440 N/mm |
| Maximum Deformation | 61% |
| Durometer | 52 Asker C |
| Specific Weight | 0.28 g/cm$^3$ |
| Elasticity* | 57% |

*: Measured according to DIN 53512.

| VGB-1A is a material with the following composition: | |
|---|---|
| EVA (21%): | 50 phr |
| Isoprene rubber: | 50 phr |
| RB-500: | 6 phr |
| Stearic acid: | 0.8 phr |

-continued

| VGB-1A is a material with the following composition: | |
|---|---|
| T4: | 1 phr |
| Zinc stearate: | 1.2 phr |
| Zinc oxide: | 2 phr |
| Dicumylperoxide: | 0.6 phr |
| Blow promoters: | 3.5 to 5.0 phr |
| Pigments: | X (depending on the color) |

The term phr indicates an amount of additives (Parts per Hundred parts of Rubber) which are added to a rubber for the "formulation" (cf. also Römpp Encyclopedia of Chemistry Version 1.3, Stuttgart/New York: Georg Thieme Verlag 1997).

This elastic material according to the invention, however, represents only a currently preferred embodiment. According to the invention, the fractions of EVA/rubber may be varied: It is also possible to use 50 to 70% ethylene vinyl acetate (EVA) and 50 to 30% natural rubber. This material has excellent elastic properties and can also be easily formed into footwear soles using common forming procedures at a low cost.

Currently good results are achieved if the above described elastic material I (VGB-1A) is used with the indicated composition. It is explicitly mentioned, however, that the above given composition does not mean that other additives could not be added to the mixture, for example, for influencing the color.

According to another embodiment of the present invention, another elastic material can also be used as follows:

TABLE 2

| Elastic Material II. | |
|---|---|
| Parameter | Material (VGB-7A) |
| Loss of energy (%) | 27% |
| Dynamic Stiffness (Force Range: 200 N–400 N) | 210 N/mm |
| Dynamic Stiffness (Force Range: 1000 N–1500 N) | 480 N/mm |
| Maximum deformation | 61% |
| Durometer | 52 Asker C |
| Specific weight | 0.28 g/cm$^3$ |
| Elasticity | 55% |

| The material VGB-7A is a material with the following composition: | |
|---|---|
| EVA 462: | 60 phr |
| Isoprene rubber 2200: | 30 phr |
| RB-500: | 6 phr |
| Engage 003: | 10 phr |

According to the present invention, the following materials are particularly useful as viscous materials:

TABLE 3

| Viscous Material I. | |
|---|---|
| Parameter | Material (B-HD45) |
| Loss of Energy (%) | 65% |
| Dynamic Stiffness (Force Range: 200 N–400 N) | 120 N/mm |
| Dynamic Stiffness (Force Range: 1000 N–1500 N) | 200 N/mm |
| Maximum Deformation | 60% |

TABLE 3-continued

| Viscous Material I. | |
|---|---|
| Parameter | Material (B-HD45) |
| Durometer | 45 Asker C |
| Specific Weight | 0.42 g/cm$^3$ |
| Elasticity | 10% |

| B-HD45 is a material with the following composition: | |
|---|---|
| Butyl-polymer: | 100 phr |
| Filling material: | 30 phr |
| Activator: | 1 phr |
| Dicumylperoxide: | 4 phr |
| Antioxidant: | 1 phr |
| Polymeric plastifier: | 3 phr |
| Blow promoter: | 4 phr |

B-HD45 is provided as sheet-stock material, and is subsequently processed to form the desired sole layer.

Alternatively, the following material may be used as a viscous material:

TABLE 4

| Viscous Material II. | |
|---|---|
| Parameter | Material (BIM-50) |
| Loss of Energy (%) | 65% |
| Dynamic Stiffness (Force Range: 200 N–400 N) | 120 N/mm |
| Dynamic Stiffness (Force Range: 1000 N–1500 N) | 200 N/mm |
| Maximum Deformation | 60% |
| Durometer | 50 Asker C |
| Specific Weight | 0.42 g/cm$^3$ |
| Elasticity | 10% |

The material BIM-50 corresponds, as far as its composition is concerned, to the above described material B-HD 45. The difference is, however, that BIM-50 is compression molded to form the sole layer. In addition, material BIM-50 can include a polnorbornene elastomer, such as the Norsorex® brand sold by Zeon Chemicals, Inc.

In comparison to the elastic and viscous materials in accordance with the present invention, the relevant parameters in view of the invention of known EVA are given in the following tables. The first table shows the data of typical EVA being processed for the forefoot part of a sole structure, whereas the second table (table 6) reflects the data of typical EVA being processed for use in the rearfoot part of a sole structure:

TABLE 5

| Comparison table for EVA (forefoot) | |
|---|---|
| Parameter | Material (EVA) |
| Energy loss (%) | 33 +/– 2% |
| Stiffness (200 N–400 N) | 260 +/– 20 N/mm |
| Stiffness (1000 N–1500 N) | 520 +/– 20 N/mm |

TABLE 6

Comparison table for EVA (rearfoot)

| Parameter | Material (B-HD45) |
|---|---|
| Energy loss (%) | 38 +/- 2% |
| Stiffness (200 N–400 N) | 120 +/- 20 N/mm |
| Stiffness (1000 N–1500 N) | 220 +/- 20 N/mm |

Figure 5:
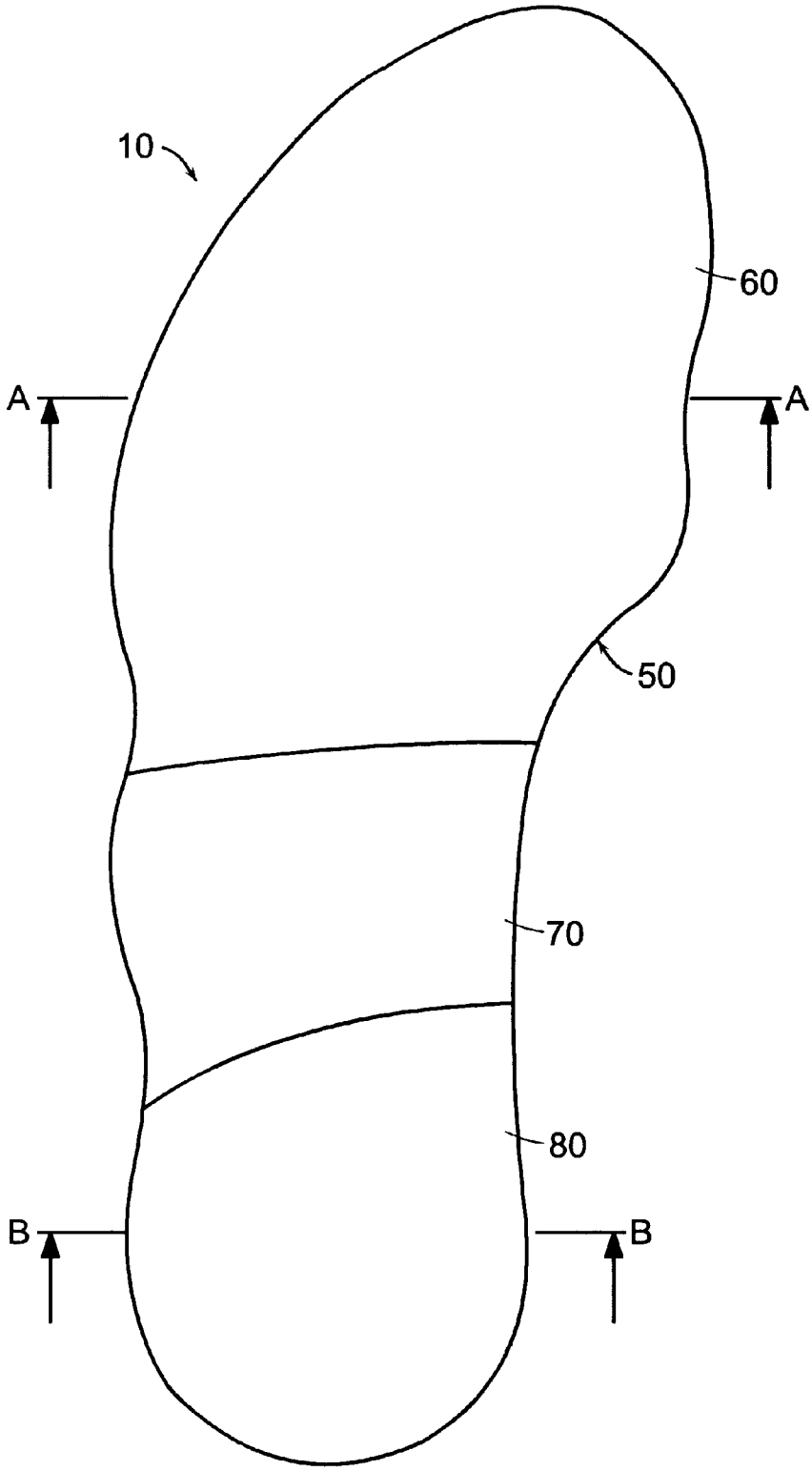
FIG. 5 a sole unit according to an embodiment of the invention where an elastic material is used in the forefoot area and a viscous material is used in the rearfoot area.
Figure 6A:
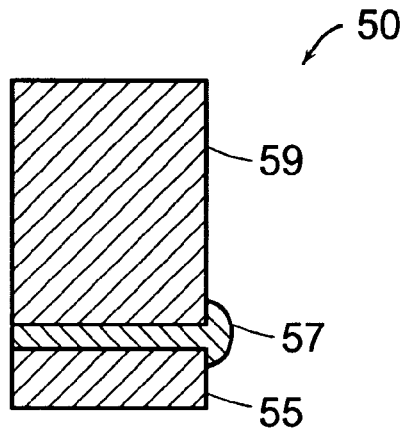
FIG. 6*a* a section along the line A—A (or B—B) of FIG. 5 showing an embodiment of the sole unit according to the invention.

FIGS. 5 and 6 show an embodiment of a sole unit in accordance with the invention taking the materials discussed in detail above into account. FIG. 5 shows a sole according to the invention in horizontal cross-section. Presented is the outsole 50 of the shoe 10 which is divided into a forefoot portion 60 and a rearfoot portion 80. The sole 50 itself can consist of a plurality of single layers, as is common in sports footwear. For example, the sole can consist of an outsole 55, a midsole 59 and an insole, not shown (FIG. 6*a*).

In one embodiment, the functional layer 57 is arranged between the outsole 55 and the midsole 59. The functional layer 57 can be divided into two horizontal parts; the forefoot portion 60 consisting of the predominantly elastic material and the rearfoot portion 80 consisting of the predominantly viscous material. Between these two horizontal parts a further transition area 70 can be provided. This, however, is not imperative, the forefoot portion 60 and the rearfoot portion 80 can contact each other directly.

According to an alternative embodiment of the present invention (not shown), two functional layers 57 can be provided. In this case, the first functional layer comprises in the forefoot portion the elastic material according to the invention and the second functional layer comprises in the rearfoot portion the viscous material according to the invention.

Figure 6B:
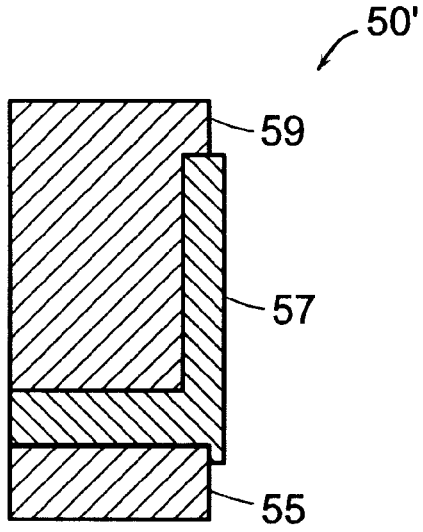
FIG. 6*b* a section along the line A—A (or B—B) of FIG. 5 showing another embodiment of the sole unit according to the invention.

As can be derived from FIGS. 6*a* and 6*b*, the functional layer 57 according to the invention extends in two preferred embodiments slightly (FIG. 6*a*), or to a large extent over the midsole 59. This depends on the use of the footwear. In cases where the probability of a sideways contact of the foot and the ground is high (in all sports involving jumping), the embodiment according to FIG. 6*b* is preferred. On the contrary, in running shoes, for example, the embodiment according to FIG. 6*a* is preferred.

With respect to the materials used according to the present invention, not only elastic, but also viscous materials are known in the prior art in principle. The materials used, however, should preferably have special properties to qualify as a sole material for footwear. In accordance with the present invention, the materials should be easy to form with common procedures, have a low weight, and a high wear and tear resistance. For this reason, many of the known materials (for example natural rubber as elastic material) cannot be considered.

Having described embodiments of the invention, it will be apparent to those of ordinary skill in the art that other embodiments incorporating the concepts disclosed herein may be used without departing from the spirit and the scope of the invention. Thus, numerous other embodiments include, but are not limited to: obtaining the necessary dynamic stiffness parameter by varying the thickness of the functional layer(s), sole layer(s), or parts thereof; and the materials in accordance with the invention need not form a complete forefoot or rearfoot portion of the sole, alternatively, smaller pieces thereof can be implemented in the respective sole parts. All are within the scope of the present invention. The described embodiments are to be considered in all respects only as illustrative and not restrictive. Therefore, it is intended that the scope of the present invention be only limited by the following claims.

What is claimed is:

1. An article of footwear, comprising:

a forefoot portion;

a rearfoot portion; and a sole including a first area that extends at least partially over the forefoot portion and a second area that extends at least partially over the rearfoot portion, the first area of the sole being constructed of an elastic material having a total material specific loss of energy and the second area of the sole being constructed of a viscous material having a different total material specific loss of energy, the difference between the loss of energy in the first area and the loss of energy in the second area being at least 20%.

2. The article of footwear of claim 1, wherein the difference between the loss of energy in the first area and the loss of energy in the second area is at least 28%.

3. The article of footwear of claim 1, wherein the difference between the loss of energy in the first area and the loss of energy in the second area is at least 35.5%.

4. The article of footwear of claim 1, wherein the solid sole comprises at least one layer, and the first area and the second area are disposed in the at least one layer of the sole.

5. The article of footwear of claim 4, wherein the first area and the second area are disposed in two different layers of the sole.

6. The article of footwear of claim 4, where the sole includes at least one additional layer.

7. The article of footwear of claim 5, wherein the sole includes at least one additional layer.

8. The article of footwear of claim 6, wherein the at least one additional layer can be an insole layer or an outsole layer.

9. The article of footwear of claim 7, wherein the at least one additional layer can be an insole layer or an outsole layer.

10. The article of footwear of claim 6, wherein the first area of the sole comprises an elastic material and is configured to have a preselected dynamic stiffness, and the at least one additional layer comprises a material and is configured to have a dynamic stiffness equal to or greater than the dynamic stiffness of the first area of the sole.

11. The article of footwear of claim 6, wherein the second area of the sole comprises a viscous material and is configured to have a preselected dynamic stiffness, and the at least one additional layer comprises a material and is configured to have a dynamic stiffness equal to or greater than the dynamic stiffness of the second area of the sole.

12. The article of footwear of claim 7, wherein the first area of the sole comprises an elastic material and is configured to have a preselected dynamic stiffness, and the at least one additional layer comprises a material and is configured to have a dynamic stiffness equal to or greater than the dynamic stiffness of the first area of the sole.

13. The article of footwear of claim 7, wherein the second area of the sole comprises a viscous material and is configured to have a preselected dynamic stiffness, and the at least one additional layer comprises a material and is configured to have a dynamic stiffness equal to or greater than the dynamic stiffness of the second area of the sole.

14. An article of footwear, comprising:

a forefoot portion;

a rearfoot portion; and a sole including a first area that extends at least partially over the forefoot portion and a second area that extends at least partially over the rearfoot portion, the first area being constructed of an elastic material having a total dynamic stiffness of less than 600 N/mm when a force between 1000N and 1500N is applied to the first area, and the second area being constructed of a viscous material having a total dynamic stiffness of less than 250 N/mm when a force between 1000N and 1500N is applied to the second area, and wherein the dynamic stiffness of the elastic material is greater than the dynamic stiffness of the viscous material.

15. An article of footwear, comprising:

a forefoot portion;

a rearfoot portion; and a sole including a first area that extends at least partially over the forefoot portion and a second area that extends at least partially over the rearfoot portion, the first area being constructed of an elastic material having a total dynamic stiffness of less than 450 N/mm when a force between 1000N and 1500N is applied to the first area, and the second area being constructed of a viscous material having a total dynamic stiffness of less than 200 N/nm when a force between 1000N and 1500N is applied to the second area, and wherein the dynamic stiffness of the elastic material is greater than the dynamic stiffness of the viscous material.

16. The article of footwear of claim 14, wherein the elastic material has a dynamic stiffness of less than 300N/mm when the force applied is between 200N and 400N, and the viscous material has a dynamic stiffness of less than 130N/mm when the force applied is between 200N and 400N.

17. The article of footwear of claim 1, wherein the elastic material comprises approximately 50% to 70% ethylene vinyl acetate and approximately 50% to 30% natural rubber.

18. The article of footwear of claim 1, wherein the elastic material comprises approximately 50% ethylene vinyl acetate and approximately 50% natural rubber.

19. The article of footwear of claim 1, wherein the viscous material comprises a butyl polymer and a polynorbonene elastomer.

20. The article of footwear of claim 1, wherein the viscous material comprises approximately 100 phr of a butyl polymer, approximately 30 phr of a filling material, approximately 1 phr of an activator, approximately 4 phr of a dicumylperoxides, approximately 1 phr of an antioxidant, approximately 3 phr of a polymer-plastifier and approximately 4 phr of a blow promoter.

21. An article of footwear, comprising:

a forefoot portion;

a rearfoot portion; and a sole including a first area that extends at least partially over the forefoot portion and a second area that extends at least partially over the rearfoot portion, the first area being constructed of an elastic material having a material specific loss of energy and having a dynamic stiffness of less than 600 N/mm when a force between 1000N and 1500N is applied to the first area, and the second area being constructed of a viscous material having a material specific loss of energy and having a dynamic stiffness of less than 250 N/mm when a force between 1000N and 1500N is applied to the second area and the difference between the loss of energy in the first area and the loss of energy in the second area is at least 20%.

* * * * *